US007021649B2

(12) United States Patent
Pascal

(10) Patent No.: US 7,021,649 B2
(45) Date of Patent: Apr. 4, 2006

(54) BOOT FOR PRACTICING A GLIDING SPORT, OR SNOWBOARD BINDING EQUIPPED WITH STRAP PARTS PROVIDING GRIPPING

(75) Inventor: Jean-Marc Pascal, Voreppe (FR)

(73) Assignee: Emery SA., Saint Egreve (FR)

( * ) Notice: Subject to any disclaimer, the term of this patent is extended or adjusted under 35 U.S.C. 154(b) by 108 days.

(21) Appl. No.: 10/408,433

(22) Filed: Apr. 7, 2003

(65) Prior Publication Data

US 2003/0201624 A1 Oct. 30, 2003

(30) Foreign Application Priority Data

Apr. 30, 2002 (FR) ..... 02 05463

(51) Int. Cl.
*A63C 9/00* (2006.01)

(52) U.S. Cl. ..... 280/617; 280/634

(58) Field of Classification Search ..... 280/607, 280/617, 618, 623, 632–634, 14.21, 14.22; 36/115; 24/68 SK, 70 SK, 71 SK
See application file for complete search history.

(56) References Cited

U.S. PATENT DOCUMENTS 5,609,347 A * 3/1997 Dressel ..... 280/14.23
6,347,436 B1 * 2/2002 Barber et al. ..... 24/68 SK
6,604,746 B1 * 8/2003 Sato et al. ..... 280/14.22

FOREIGN PATENT DOCUMENTS

WO 96/24412 8/1996

* cited by examiner

*Primary Examiner*—Bryan Fischmann
(74) *Attorney, Agent, or Firm*—Burr & Brown

(57) ABSTRACT

The invention relates to a snowboard binding including a baseplate and at least one strap formed from at least one strap part articulated relative to one side of the baseplate, capable of interacting with fastening mechanisin connected on the other side of the baseplate in order to allow gripping of the user's boot in the binding. This binding is defined in that each strap part has two stable equilibrium positions, namely an open position in which the strap part is released from the front of the binding and a closed position in which the strap part is folded down over the front of the binding in order to interact with the fastening mechanism, the articulation of the strap part relative to the binding being arranged in order that, between these two positions, the strap part is displaced automatically toward one of the two stable positions.

8 Claims, 4 Drawing Sheets

BOOT FOR PRACTICING A GLIDING SPORT, OR SNOWBOARD BINDING EQUIPPED WITH STRAP PARTS PROVIDING GRIPPING

FIELD OF THE INVENTION

The invention relates to the field of gliding sports, and particularly to sports involving gliding over snow, and principally snowboarding. However, the invention also has applications in the field of cross-country skiing or that of roller-skating or ice-skating. The invention refers more particularly to a strap part that can be used on snowboard bindings or, alternatively, on boots. The invention relates more specifically to the articulation of such a strap part on the boot and the bindings, facilitating fitting operations.

BACKGROUND OF THE INVENTION

Generally, snowboard bindings for use with soft boots include a baseplate fixed on the board and a highback for receiving the bearing forces of the rear of the leg. The boot is held inside the binding by a set of straps allowing the boot to be gripped inside the binding. These straps pass generally over the front of the foot and over the instep, and connect the two sides of the baseplate. More precisely, each strap consists generally of at least one strap part that is fixed on the side of the baseplate. This strap part is able to interact either with a complementary strap part located on the other side of the baseplate or even with a fastening mechanism associated with the other side of the baseplate.

Conventionally, these strap parts consist of a non-extendible but deformable material. In point of fact, this strap part must be able to be shifted on the binding side to allow the user to insert his boot in the binding. This strap part is, however, non-extendible, since its primary function is to hold the boot firmly inside the binding.

A number of drawbacks arise from the fact that this strap part must, at one and the same time, have a certain rigidity and the ability to deform. Indeed, in order for it to be deformed easily, so as to open up the baseplate space, the strap part must be relatively flexible. However, too great a flexibility may make it more likely to fail. Conversely, too great a rigidity impedes easy opening of the binding.

This is why it has already been proposed to fit these strap parts on the baseplate by means of an articulation that facilitates its pivoting movement for the operations of opening and closing the binding. In more improved embodiments, this articulation takes the form of a part that is itself mounted on the baseplate and has a supplementary ability to pivot on a transverse axis of the baseplate. This ability to pivot allows the strap to be adjusted to the shape of the boot reasonably high over the instep or more or less at the front of the front end of the boot.

However, it is observed that the solutions in which the strap parts are articulated in order to facilitate their opening present certain drawbacks. In fact, owing to the relative flexibility of the strap part, the latter tends to systematically move back into the closed position when the binding is subjected to transverse movements, particularly when the user is stepping into the other binding. This tendency is further increased since the strap parts are generally equipped in their terminal portion with a pad for distributing and attenuating the pressure exerted by the strap over the user's foot. The presence of this relatively large mass at the end of the strap part very easily causes it to pivot. Moreover, during transportation, it is impractical to have bindings with strap parts that are free to pivot.

One solution has already been proposed to allow easy fitting into the binding, in document WO 96/24412. More precisely, the binding described in that document has strap parts that are articulated relative to the baseplate and of which the articulation extends inside the baseplate via portions that are capable of receiving the bearing forces of the foot. Thus, when the user steps into the binding, the strap parts are automatically folded above the boot, such that the user has to perform only the operations of positioning the fastening means. Although it facilitates the fitting operations, this solution does not, however, eliminate the drawbacks relating to the freedom of the strap parts to pivot.

Therefore, the invention proposes to eliminate the inconvenience caused to the user when the strap parts pivot at an inopportune time.

The same type of problem arises in the case of ski boots or, alternatively, boots for roller-skating or ice-skating. In fact, these boots are generally equipped with fastening hooks mounted at the end of strap parts that are able to lie over the front (or rear) part of the boot and thus grip the boot upper. In point of fact, when the user wishes to put the boot on, it is generally necessary for him to open up the boot shell, possibly by pulling the liner tongue outward. This therefore requires the space that will subsequently be occupied by the gripping strap parts to be totally free, which is not the case of the majority of existing boots. Indeed, the strap parts of the gripping straps of boots currently used are rigid and require the user to hold them apart in order to be able to carry out the operations of putting the boot on. Certain ski boots have been proposed with an articulation for the strap parts of the gripping straps. The free pivoting of the strap parts generates the same drawbacks as those described above in the case of bindings.

SUMMARY OF THE INVENTION

The invention relates firstly to a snowboard binding that includes, in a known manner, a baseplate and at least one strap. This strap is formed of at least one strap part that is articulated relative to one side of the baseplate, capable of interacting with fastening means connected on the other side of the baseplate in order to grip the user's boot inside the binding.

The invention also relates to a boot for practicing a gliding sport, such as skiing or skating. This boot comprises, in a known manner, at least one strap part that is articulated relative to one side of the boot, capable of interacting with the fastening means connected on the other side of the boot, in order to grip the user's foot inside the boot.

According to the invention, the binding or the boot are defined in that each strap part has two stable equilibrium positions, namely an open position in which the strap part is clear of the front of the binding or of the boot and a closed position in which the strap part is folded down over the binding or the boot, the articulation of the strap part relative to the binding or the boot being arranged in order that, between these two positions, the strap part is displaced automatically toward one of the two stable positions.

In other words, the strap part fitted to the bindings or the boots in accordance with the invention remains in either the folded-down or the open position until the user wishes to move it into the opposite position. This means, therefore, that, when the strap part is in the open position, even when the binding or the boot undergoes reasonably large movements, there is no risk of seeing the strap part return to the closed position in which it would impede the user's operations. Conversely, when the strap part is in the closed position, over the binding of the boot, and even when it is unfastened, it is impossible for it to open inopportunely without the user carrying out the appropriate operation. In particular, this preventsthe strap part from opening inopportunely and, for example, striking the opposite boot and impeding the user when the hooks of a boot are detached.

On the contrary, the user has to exert a sufficiently intense force in order to counteract the characteristic articulation and to change it from one stable position to the other.

In practice, the straps for gripping the boot of the binding may include two bistable strap parts, one of which has means capable of interacting with the opposite strap part. These two strap parts may, for example, lay on the snowboard boot when the latter is positioned in the binding, such that fastening is substantially in the central part of the boot. However, the invention also covers variant embodiments in which the strap consists of only one strap part, the end of which interacts with a fastening zone located on the opposite side of the baseplate, without these fastening means actually being mounted on a strap part.

The articulation of the strap part may be either directly on the boot or the baseplate of the binding or on a part that is itself fixed on the binding or the boot. In the more precise case of the snowboard binding, this supplementary part may itself be articulated on the baseplate in order to allow the strap to pivot relative to an axis transverse to the foot.

The bistable nature of the strap part may be obtained using various mechanical solutions.

Thus, in a first embodiment, the strap part includes a flexible spring that is, at one end, connected to the strap part and, at its other end, to a zone that is fixed relative to the binding or the boot, at a point other than the point of articulation. Thus, the spring works in buckling resistance when it moves from one position to the other, thus requiring a sufficient force on the part of the user.

In another embodiment, the articulation of the strap part includes, on the one hand, a curved pin and, on the other hand, a housing, having a zone of curvature that complements that of the curved pin, in which the pin is housed when the strap part is in a stable equilibrium position, movement to the other stable equilibrium position giving rise to the transverse bending of the end of the strap part. In other words, the articulation is achieved via a pin that is not rectilinear, but curved. In an equilibrium position, the curved pin lies in the complementary curvature of the housing. In the other position, the curved pin gives rise to the deformation of the strap part over its width.

In practice, various structures are possible. In a first embodiment, the curved pin is fixed, i.e. secured to the binding or to the boot. The housing that has the two zones of curvature that complement the pin is therefore produced at the end of the strap part located on the articulation side.

The reverse structure is also possible, in which the pin is located at the end of the strap part. In this case, it pivots in a housing that is fixed relative to the binding or to the boot.

In the particular case of the binding, the curved pin may be located on an intermediate part mounted on the upper region of one of the two lateral walls of the baseplate. In such a case, the zone of this intermediate part on which the curved pin is mounted may extend above the lateral wall toward the inside of the baseplate such that the curved pin is located vertical vis-a-vis the wall of the baseplate.

BRIEF DESCRIPTION OF THE DRAWINGS

The implementation of the invention and the advantages arising therefrom will become clearly apparent from the description of the embodiments that follow, supported by the appended figures.

DETAILED DESCRIPTION OF THE INVENTION

Figure 1:
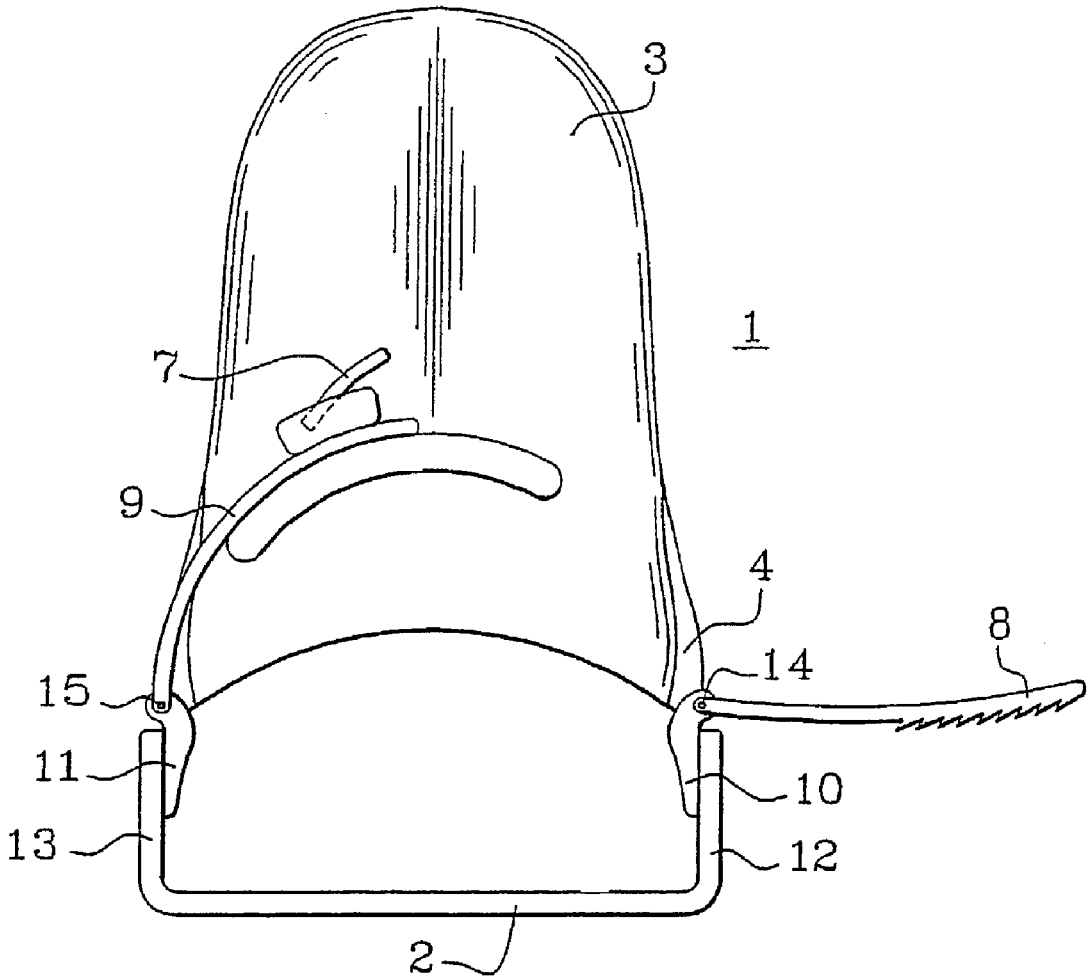
FIG. 1 is a front view of a snowboard binding equipped with strap parts according to the invention.
Figure 2:
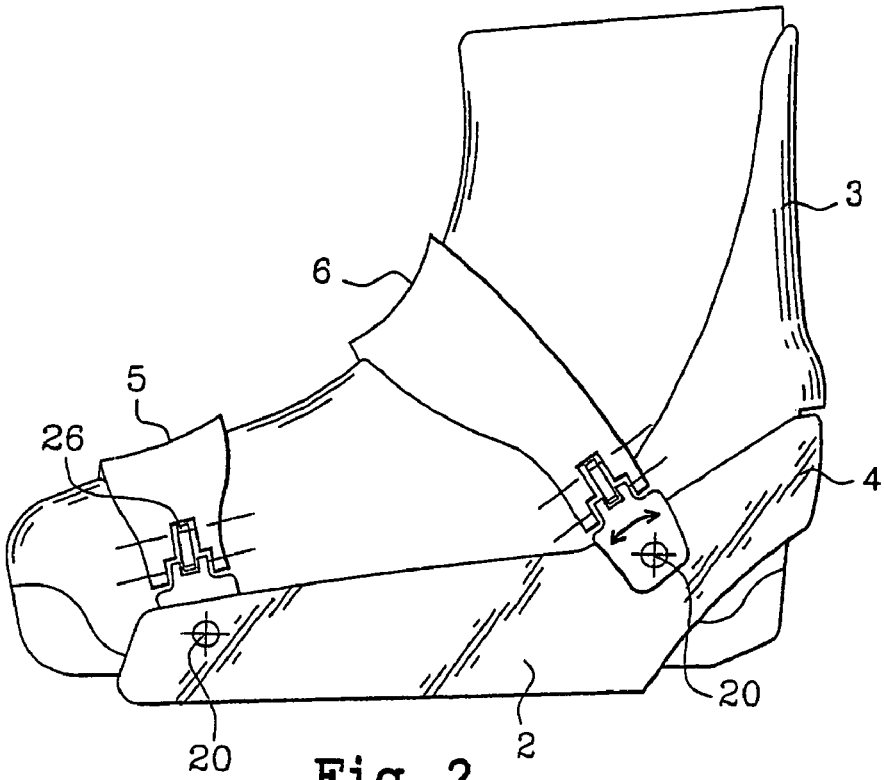
FIG. 2 is a side view of the same binding.

Generally, a snowboard binding (1) for receiving soft boots comprises, as illustrated in FIG. 1, a baseplate (2) for mounting on the board and a highback (3), for receiving the bearing forces of the rear of the leg, that is mounted pivotably on the baseplate (2) in the region of a rear heel loop (4). Traditionally, such a binding comprises two gripping straps (5, 6), as shown in FIG. 2, for holding the user's boot in the binding. These gripping straps (5, 6) are generally arranged at the front end of the binding so as to lay over the zone of the metatarsophalangeal joint, and at the instep.

Generally, such straps are composed of one or two strap parts that can be articulated relative to the baseplate and that interact with one another in the region of the fastening means (7) allowing the precise positioning of one strap part relative to the other and thus the gripping of the boot. In certain cases, the strap includes only one strap part and the fastening means (7) are mounted directly on one side of the baseplate without actually being mounted on a strap part.

In the embodiment illustrated in FIG. 1, the two strap parts (8, 9) are articulated on the baseplate (2) in the region of supplementary parts (10, 11) that are secured, by a fastener, onto the inner faces of the sides (12, 13) of the baseplate (2). In this way, the articulation pin (14, 15) of these strap parts (8, 9) is located in line with the sides (12, 13) of the baseplate (2), which promotes good gripping of the boot. The strap parts (8, 9) illustrated in FIG. 1 correspond to the gripping strap (5) of FIG. 2, which is located at the front of the foot. It will be observed that the articulation part of the strap part may also be mounted on the outside of the sides of the baseplate and, for example, at the point where the heel loop (4) starts.

As will be seen in FIG. 2, these articulation parts may have the ability to pivot about fastener axis (20), making it possible to adjust the position of the gripping strap (6) relative to the instep, in particular, to adapt gripping to different shapes of boot.

According to the invention, the articulations of the strap parts of the gripping straps are bistable, i.e. they can adopt two stable equilibrium positions requiring the user's intervention in order to move from one to the other. In other words, the two strap parts (8, 9) illustrated in FIG. 1 remain in their open position (the notched strap part (8)) and the closed position (the strap part (9) bearing the fastening means) even if the binding is subjected to large movements and until the user exerts a sufficient force. This bistable effect may be obtained by various structures and, in particular, that illustrated in FIGS. 2 to 4.

Figure 3:
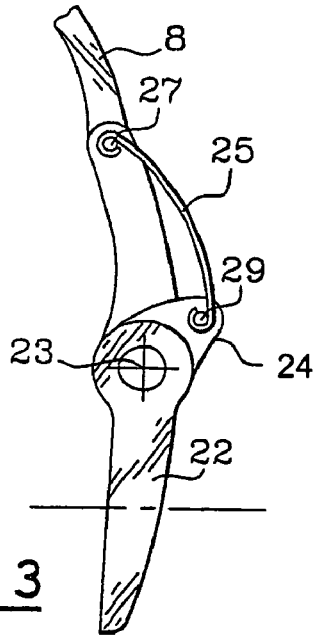
FIGS. 3 and 4 are side and detail views of the articulation mechanisms of the strap parts relative to the baseplate of the binding, corresponding to a first variant embodiment.
Figure 4:
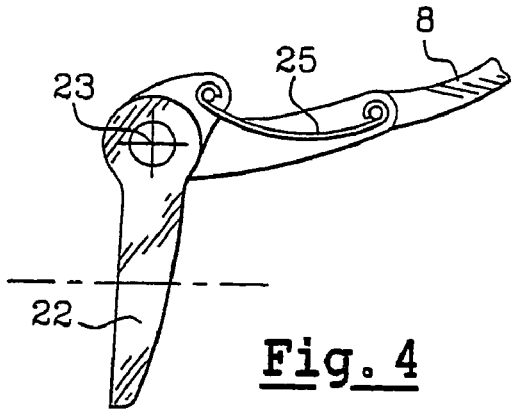

More precisely, and as illustrated in FIG. 3, the strap part (8) is articulated relative to the baseplate in the region of an intermediate articulation part (22) bearing the articulation axis (23). In the central portion connecting it to the intermediate part (22), the strap part (8) has a flexible spring (25), for example made of metal, that is fixed to strap part (8) inside of an opening (26) in the region of an articulation pin (27). This spring (25) is fixed at its other end to a protrusion (24) of the intermediate part (22), also with a capacity for articulation. The second articulation point (29) of the spring (25) is offset relative to the articulation axis (23) of the strap part (8) on the intermediate part (22). Thus, when the strap part (8) is pivoted into the open position, as illustrated in FIG. 4, the spring (25) initially opposes this movement, which the user must thus counteract.

The spring (25) resists buckling until a position of maximum stress located between the closed position and the open position. If the strap part is released before this position is reached, the spring (25) tips the strap part (8) back into the closed position. Conversely, if the strap part has gone beyond this position of maximum stress, the spring (25) presses the strap part into the open position, as illustrated in FIG. 4. In the same way, when the strap part (8) is in the open position as illustrated in FIG. 4, it is necessary for the user to exert sufficient force in order to cause the spring (25) to buckle. This level of force is greater than the inertia of the strap part (8), even when the binding undergoes significant displacements, for example during operations involving the fitting of the boot. There is, therefore, no risk of seeing the strap part unexpectedly close.

Figure 5:
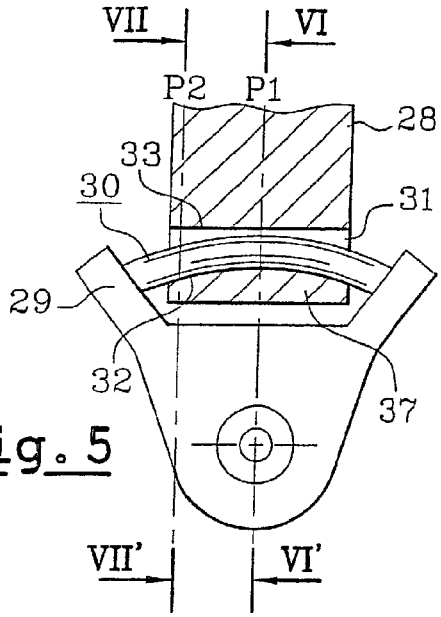
FIG. 5 is a front view of a second variant embodiment of the articulation mechanism of the strap part on the baseplate.
Figure 6A:
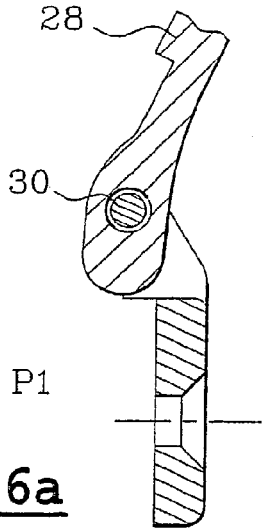
FIGS. 6*a* and 6*b* are sectional views on plane VI–VI' in FIG. 5, showing the strap part in two different positions.
Figure 7A:
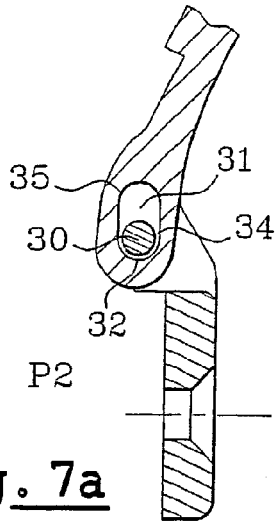
FIGS. 7*a* and 7*b* are side views of the articulation in FIG. 5, also shown in two positions of the strap part.
Figure 6B:
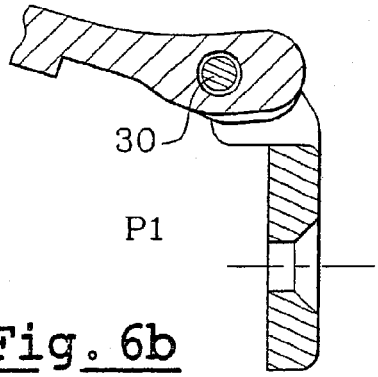

The bistable characteristic of the strap part may be obtained in another way and as illustrated in FIGS. 5 to 7. More precisely, in this embodiment, the strap part (28) is articulated on an intermediate part (29) that is itself mounted on the baseplate of the binding and that includes a curved pin (30) as illustrated in FIG. 5. This curved pin (30) penetrates a housing (31) made at the end of the strap part (28). The geometry of this housing (31) is specific in order to generate the bistable effect. The portion (32) of this housing (31) closest to the end of the strap (28) has a curvature that is substantially equivalent to that of the curved pin (30) in the region of its face that comes opposite it. As far as the opposite wall (33) of this housing is concerned, it is substantially rectilinear. Therefore, when the strap part is in the closed position, illustrated in FIG. 5, the curved pin (30) is positioned inside the housing without exerting any particular stress, since, in this orientation, the housing (31) has a volume greater than the space taken up by the curved pin (30). As illustrated in FIG. 6*a*, the central part of the curved pin (30) comes practically into contact with the periphery of the housing located in the plane VI–VI'. At the ends of the housing, the curved pin (30) is in contact with the portion (32), that is also curved, of the housing, as seen in FIG. 7*a*.

Figure 8:
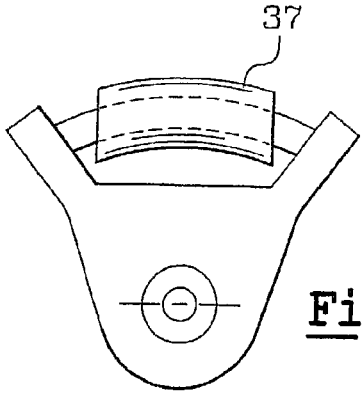
FIG. 8 is a view similar to FIG. 5, in which the strap part is folded down.
Figure 7B:
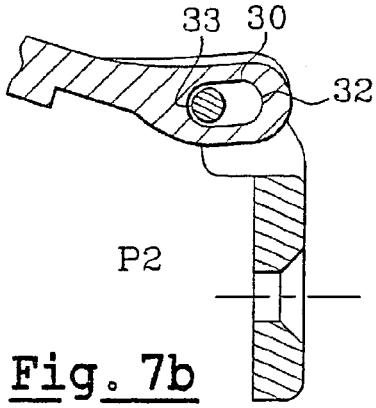

When the strap part (28) undergoes forces in the direction of opening, the shape of the housing (31) is such that the curvature of the pin (30) opposes the pivoting of the strap part as the curved pin (30) then stresses the faces (34, 35) of the housing that are parallel to the faces of the strap part. If a relatively great force is exerted, however, the end (37) of the strap part is able to deform in order to curve and to bend in accordance with FIG. 8. In such a case, and as illustrated in FIG. 7*b*, the curved pin is in contact with the opposite wall (33) of the housing (31) furthest from the end of the strap part. This equilibrium position is stable, since the strap part adopts a complementary curvature in the zone of the pin. In order to move into a closed position, it is necessary to counteract this curvature, which requires a relatively great force. In other words, when the strap part is in the open position, it cannot fold down unexpectedly without the user's intervention.

Figure 9:
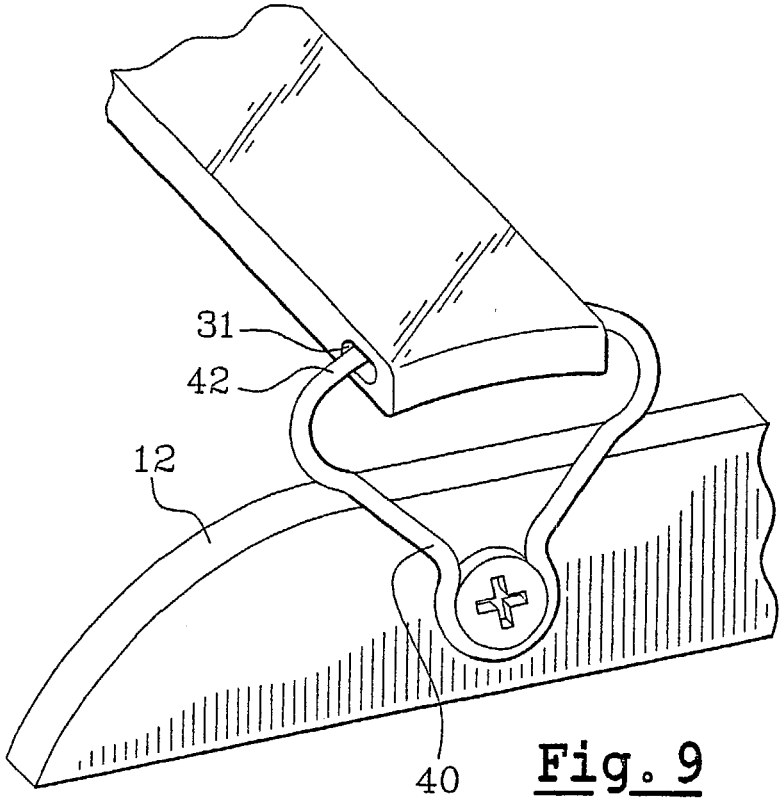
FIG. 9 is a summary perspective view of a variant embodiment.

Different variant structures may be produced and, in particular, that illustrated in FIG. 9, in which the intermediate part (40) consists of a metal wire that is curved in order to have the characteristic curvature in the zone (42) penetrating the housing of the strap part. This intermediate part (40) is also curved such that the curved metal wire in zone (42) is in line with the side (12) of the baseplate.

Naturally, further variant embodiments may be envisaged and, in particular, that in which the strap part is equipped with the curved pin, and in such a case it is the intermediate part that includes the complementary housing.

Figure 10:
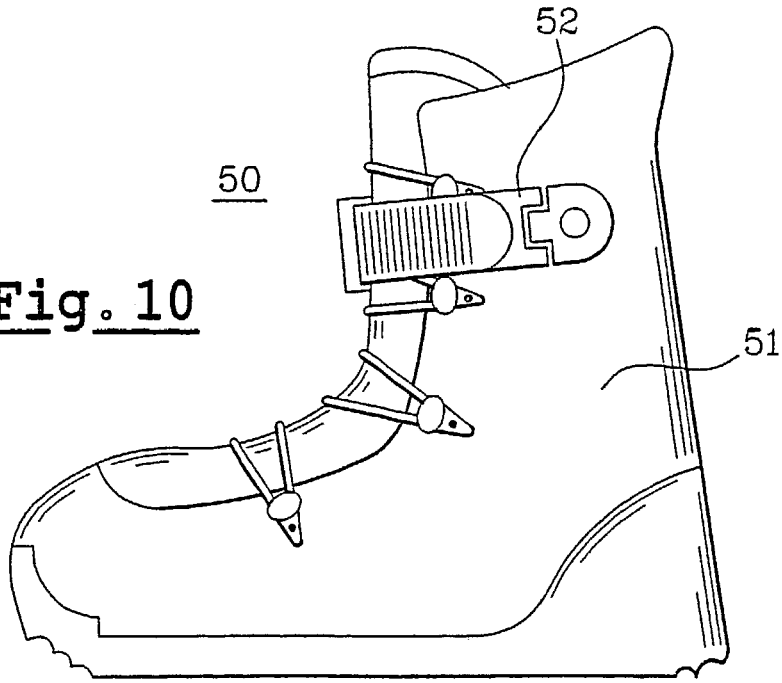
FIG. 10 is a general view of a snowboard boot equipped with a strap part according to the invention.

As already mentioned, the invention may also apply to a ski boot or to a boot used in combination with a roller-skate or an ice-skate. In such a case, and as illustrated in FIG. 10, the strap parts (52) may be mounted on either side of the shell (51) of the boot (50), according to conventional structures for this type of boot.

It emerges from the foregoing that the strap parts arranged according to the invention have several advantages and, in particular, that of preventing the unexpected pivoting of the strap part over the binding or over the front of the boot, which enables the user to step into the binding or the boot without having to pay attention to the position of the strap parts once they have been opened. Moreover, it is possible to transport the bindings without necessarily locking the fastening means, since the strap parts naturally lie in a stable equilibrium position.

The invention claimed is:

1. A snowboard binding including a baseplate and at least one strap formed from at least one strap part articulated relative to one side of the baseplate, capable of interacting with fastening means connected on another side of the baseplate in order to grip a boot in the binding, wherein each strap part has two stable equilibrium positions, namely an open position in which the strap part is released from the binding and a closed position in which the strap part is folded down over the binding in order to interact with the fastening means, said binding further comprising means for articulating the strap part relative to the binding so that, between the open and closed positions, the strap part is displaced automatically toward either one of the two stable equilibrium positions depending on the location of the strap part.

2. The binding as claimed in claim 1, wherein each strap includes two strap parts, one of which has fastening means capable of interacting with the opposite strap part.

3. The binding as claimed in claim 1, wherein the articulation of the strap part is at a part that is itself fixed on the binding.

4. The binding as claimed in claim 1, wherein the strap part includes a flexible spring, one end of which is articulated on the strap part and the other end of which is articulated relative to a fixed point on the binding, at a point other than a point of articulation of the strap part, such that the spring works in buckling resistance in order to move from one equilibrium position to the other.

5. The binding as claimed in claim 4, wherein the flexible spring is located in a zone (26) cut into a central region of the strap part.

6. The binding as claimed in claim 1, wherein the articulation of the strap part includes, on the one hand, a curved pin and, on the other hand, a housing, having a zone of curvature that complements that of the curved pin, in which the pin is housed when the strap part is in a stable equilibrium position, movement to the other stable equilibrium position causing the transverse bending of the end of the strap part.

7. The binding as claimed in claim 6, wherein the curved pin is integral with the binding, and wherein the housing having the zone of curvature that complements the pin is made at the end of the strap part located on the articulation side.

8. The binding as claimed in claim 7, wherein the articulation pin is located on a part mounted on the upper region of one of the lateral walls of the baseplate, the zone of the said part on which the pin is mounted projecting above the lateral wall and toward the inside of the baseplate such that the pin is located on the vertical of the wall of the baseplate.

* * * * *